United States Patent [19]

Entrikin et al.

[11] Patent Number: 4,746,069

[45] Date of Patent: May 24, 1988

[54] CENTRIFUGAL MEDIA MILL

[75] Inventors: Raymond A. Entrikin; Roy A. Nelson; Randolph C. Grieves, all of South Haven, Mich.

[73] Assignee: Epworth Manufacturing Co., Inc., South Haven, Mich.

[21] Appl. No.: 31,142

[22] Filed: Mar. 24, 1987

Related U.S. Application Data

[60] Continuation of Ser. No. 831,233, Feb. 19, 1986, abandoned, which is a division of Ser. No. 688,267, Jan. 2, 1985, Pat. No. 4,582,266, which is a continuation of Ser. No. 422,419, Sep. 23, 1982, abandoned.

[51] Int. Cl.[4] ..... B02C 23/36

[52] U.S. Cl. ..... 241/27; 241/30

[58] Field of Search ..... 241/27, 26, 30, 176, 241/172

[56] References Cited

U.S. PATENT DOCUMENTS

| | | | |
|---|---|---|---|
| 3,018,059 | 1/1962 | Lödige et al. | 241/172 X |
| 3,028,104 | 4/1962 | Hall | 241/176 |
| 3,199,792 | 8/1965 | Norris, Jr. | 241/30 |
| 3,202,364 | 8/1965 | Wieland | 241/172 X |
| 4,244,531 | 1/1981 | Szegvari | 241/172 |

*Primary Examiner*—P. W. Echols
*Assistant Examiner*—Joseph M. Gorski
*Attorney, Agent, or Firm*—Flynn, Thiel, Boutell & Tanis

[57] ABSTRACT

A mill for effecting in a particulate-containing substance a reduction in size of the particulate. The mill includes a support on which is rotatably mounted a vessel having a comminuting media contained therein. A shaft extends centrally of the vessel and is fixedly secured thereto to rotate with the vessel. Plural planar discs are secured to the shaft and extend in a plane transverse to the axis of rotation of the vessel. Planar blades are secured to both the disc and to the vessel so that the vessel, shaft, discs and blade means rotate as a unit. A spacing is provided between the radially outermost extremity of the blade means and the discs and the internal surface of the vessel. Deflector members are oriented in the spacing for deflecting media radially inwardly into engagement with the discs and blades so that the disc and blades can accelerate the comminuting media radially outwardly in response to a rotation of the vessel and connected discs and blades.

3 Claims, 6 Drawing Sheets

CENTRIFUGAL MEDIA MILL

This application is a continuation of U.S. Ser. No. 831,233, filed Feb. 19, 1986, abandoned concurrently herewith, which is a division of application Ser. No. 688,267, filed Jan. 2, 1985, now U.S. Pat. No. 4,582,266, which is a continuation of Ser. No. 422,419, filed Sept. 23, 1982, now abandoned.

FIELD OF THE INVENTION

This invention relates to methods and apparatus for comminuting a particulate-containing substance to effect a reduction in the size of the particulate therein.

BACKGROUND OF THE INVENTION

Many devices are known for effecting a reduction in the size of a particulate in a particulate-containing substance. A listing of such prior art devices is set forth in the "Description of the Prior Art" appearing in U.S. Pat. No. 4,244,531. As the prior art will reveal, various structures have been employed over the years to effect an agitation of the comminuting media to effect the desired result. Each of these various structures provides varying degrees of shear forces and impact forces for effecting the desired reduction in size of the particulate.

It is frequently desirable to cause particle size reduction of a solid contained in a liquid. Liquids are frequently wanted and desirable in the total product system. For example, liquids tend to replace undesirable gases held by the particle. Further, more uniform particle size distribution is obtainable with liquid additions and a desired reaction or bond may even be created. However, in continuous type mills, that is, mills wherein a product is continually introduced into the comminuting vessel at one end and the comminuted mixture is removed at the opposite end, a strong desire has existed for many years in providing apparatus which would quickly process the product flowing therethrough so as to increase the productivity of the mill. However, the length of time that the product remains in the mill is directly related to the particle size of the particulate desired in the output mixture. Further, considerable energy is consumed during the period of time that the mill is in operation. Thus, the cost of energy per unit of product can be greatly diminished if the amount of product being processed through the mill can be substantially increased. A need has also existed for many years for a continuous type mill wherein a particulate-containing product which is to be processed is introduced at one end and the processed mixture removed at the other end, to have a minimum of seals for preventing leakage of comminuting media as well as product to be processed from the vessel. It is highly desirable to provide a mill having only one seal while permitting product to be processed to be introduced at one end of the vessel and effectively removed at the opposite end, thereby causing the product to flow continuously through the agitated comminuting media.

Accordingly, it is an object of this invention to provide a mill for continuously processing product or batch processing product wherein the comminuting media is sufficiently agitated and with a minimum of friction occurring between the moving parts to achieve the desired amount of comminution of a particulate-containing product.

It is a further object of this invention to provide a continuous type mill, namely, a mill wherein product is introduced at one end of the vessel and the comminuted mixture removed at the opposite end, wherein the comminuting media is sufficiently agitated and with a minimum of friction occurring between the moving parts to achieve the desired amount of comminution of a particulate-containing product.

It is a further object of the invention to provide a mill, as aforesaid, wherein the speed of rotation of the vessel and related shaft and blade members is selected based on the size of the media, the density of the media and the viscosity of the product to be processed, so that the centrifugal force generated during a rotation of the vessel and related shaft and blade members will cause the media to generate a force equal to many times the weight of the media and to further provide an interruption of the movement of the comminuting media to effect a deceleration of the comminuting media only to have it reaccelerated again to generate the desired comminuting action in the media.

It is a further object of this invention to provide a mill, as aforesaid, wherein only one rotary or shaft seal structure is provided for preventing comminuting media and product from leaking out of the vessel.

It is a further object of this invention to provide a mill, as aforesaid, wherein an increase in the output of the comminuted mixture is effected thereby reducing the energy consumed in comminuting the product per unit of product produced.

It is a further object of this invention to provide a mill, as aforesaid, which is durably constructed and which will provide a generally maintenance-free operating characteristic.

SUMMARY OF THE INVENTION

In general, the objects and purposes of the invention are met by providing a mill having the capability of being a continuous type mill, but is not to be limited thereto, for effecting a reduction in the size of a particulate embodied in a particulate-containing substance. The mill includes a support on which is rotatably mounted an elongated vessel with a drive mechanism operatively connected thereto. A shaft is centrally mounted in the vessel for rotation therewith and disc members and blade members are fixedly secured to the shaft and thence to the vessel for rotation therewith as well. Deflector members are provided in the spacing between the radial extremity of the disc and blade members and the internal surface of the vessel for deflecting a comminuting media contained in the vessel radially inwardly into engagement with the disc and blade members so that the disc and blade members can accelerate same again radially outwardly in response to a rotation of the shaft, disc and blade members as well as the vessel.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
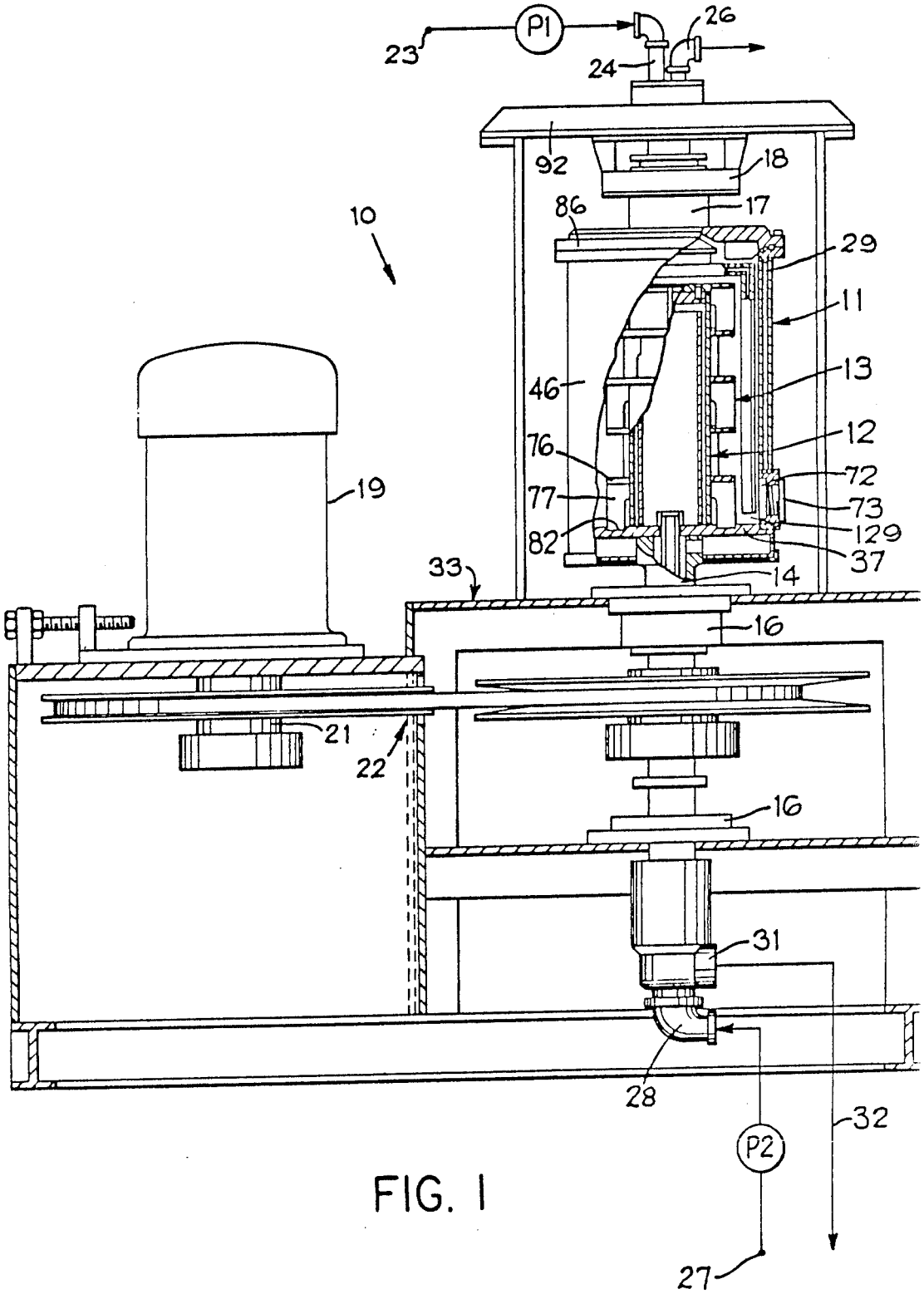
FIG. 1 is a partially sectioned side elevational view of a continuous type mill embodying the invention.

Certain terminology may be used in the following description for convenience in reference only and will not be limiting. The words "up", "down", "right" and "left" will designate directions in the drawings to which reference is made. The words "forward" and "rearward" will refer to the direction of material flow through the device, "forwardly" being the normal flow direction. The words "in" and "out" will refer to directions toward and away from, respectively, the geometric center of the device and designated parts thereof. Such terminology will include the words above specifically mentioned, derivatives thereof and words of similar import.

In accordance with the preferred embodiment shown in the drawings, an agitated media comminuting mill 10 includes a comminuting vessel 11, a portion of which is broken away to show the internal structure of the mill as hereinafter described. Although the comminuting vessel 11 is substantially a right circular cylinder, vessels having other geometries, such as an inverted cone, can also be used for certain applications. The vessel 11 includes a centrally disposed shaft 12 therein which, in this particular embodiment, is fixedly secured to the vessel 11. A plurality of disc-blade sets 13 are fixedly secured to the shaft and, therefore, fixedly secured to the vessel. The vessel 11 is rotatably supported on an upstanding shaft 14, which shaft 14 is rotatably supported in a pair of axially spaced bearing structures 16 located at the lower end of the vessel 11. The vessel 11 also has an upstanding neck portion 17 at the upper end thereof which is rotatably received in a bearing construction 18. The shaft 14 is rotatably driven by an electric motor 19, the output shaft 21 of which is connected to the shaft 14 through a preferably variable speed transmission device 22.

A particulate-containing and flowable substance is introduced from a reservoir 23 into the vessel through an inlet connection 24 by means of a variable speed pump P1. Comminuted product is removed from the vessel through an outlet connection 26. In addition, and in order to maintain the vessel at a desired operating temperature, a heat exchanging fluid is introduced from a reservoir 27 to an inlet connection 28 by means of a variable speed pump P2. The heat exchanging fluid can also be supplied from a pressurized source controlled by a valve so that the pump P2 could be eliminated. The inlet connection 28 is connected in fluid circuit with a passageway system 29 surrounding the vessel 11. The heat exchanging fluid is removed from the passageway system 27 through an outlet connection 31 and an appropriate connecting line 32 schematically illustrated. The vessel 11 and the electric motor 19 are mounted on an appropriate support structure 33 which will not be described in any detail.

The foregoing discussion describes only in general terms the various structural components of the continuous type mill 10. The following description will describe in more detail the various components of the mill.

Figure 3:
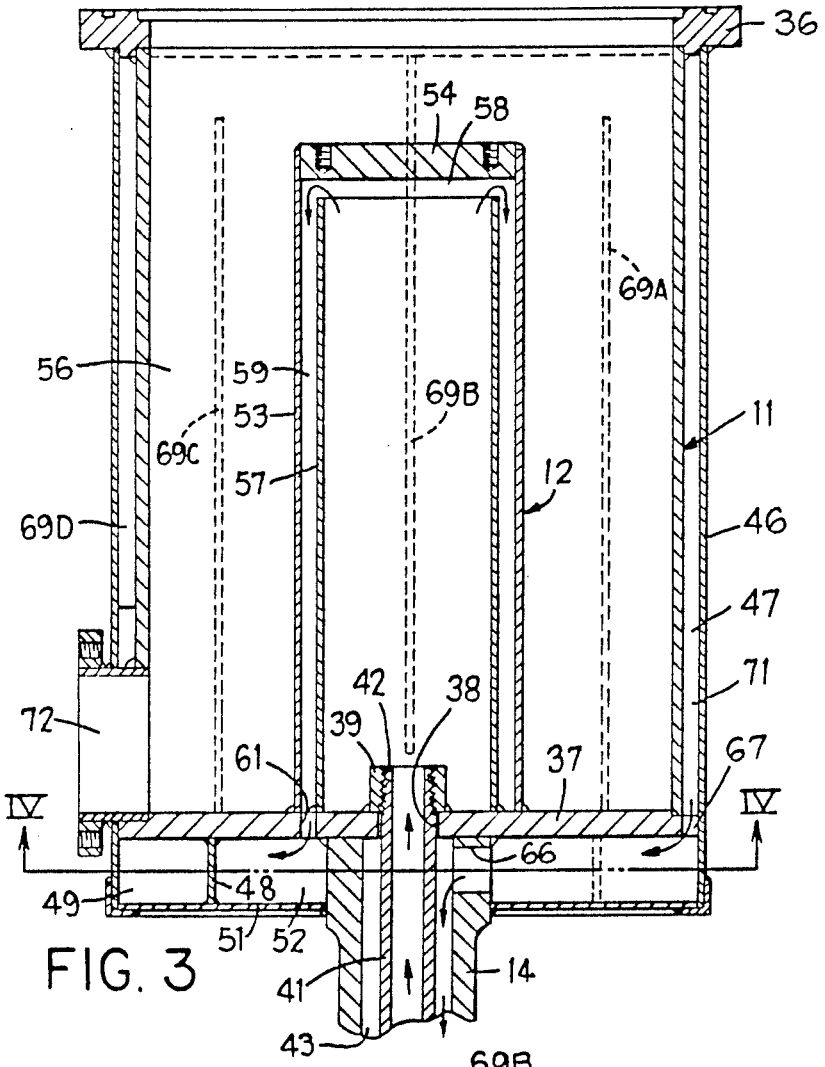
FIG. 3 is a central sectional view of the vessel and centrally disposed shaft without the disc and blade members being operatively connected thereto, said central section being taken along the line III—III of FIG. 4.

Referring to FIG. 3, the vessel and the centrally disposed shaft 12 are illustrated but without the disc-blade sets 13 being disposed on the shaft. As stated above, the vessel 11, in the preferred embodiment, is a right circular cylinder having an annular ring 36 fixedly secured to one end thereof and a plate 37 closing off the other end thereof. While the vessel is disclosed in this particular environment in an upright position, it is to be noted that this arrangement can also be utilized with a vessel lying on its side. Therefore, and while the following discussion will describe the vessel in its upright illustrated position, such discussion concerning the orientation thereof is not to be limiting. Thus, and in this particular embodiment, the annular ring 36 is located at the top of the vessel and the plate 37 closes off the bottom of the vessel. The plate 37 has a centrally disposed hole 38 therethrough and an upstanding, coupling member 39 encircling the hole 38 secured to the inside of the vessel 11. The shaft 14 is a hollow shaft and is fixedly secured to the underside of the plate 37 and in axial alignment with the hole 38 and coupling member 39. A pipe 41 is coupled to the coupling member 39 by any convenient means such as by a threaded connection 42. The pipe 41 extends inside the hollow shaft 14. Further, the peripheral wall surface of the pipe 41 is spaced radially inwardly of the internal surface of the hollow pipe 41 to define a spacing 43.

Figure 4:
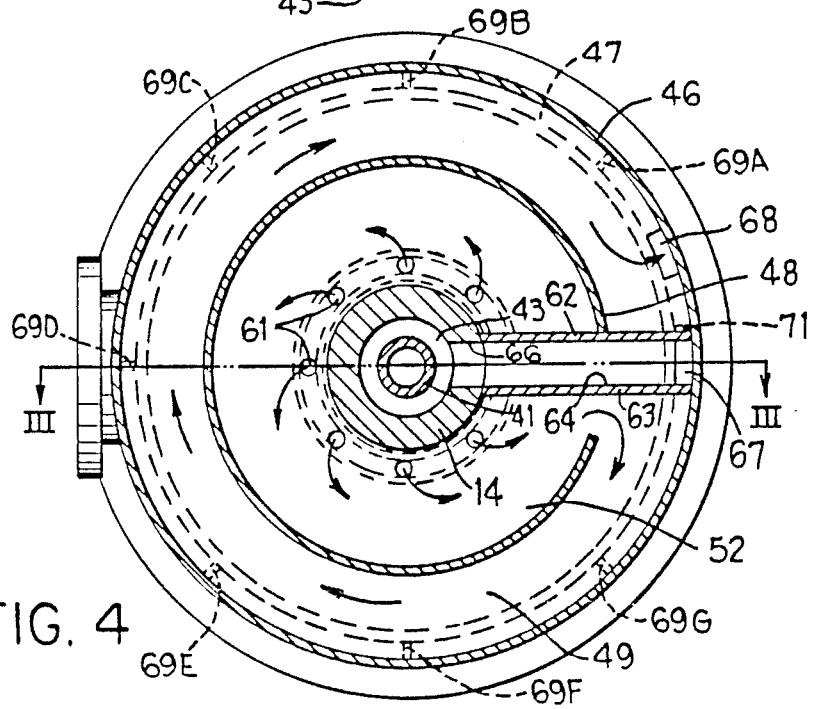
FIG. 4 is a sectional view taken along the line IV—IV of FIG. 3.

A right circular cylindrical shell 46 is fixedly connected at one end to the annular ring 36 and extends in a telescoped manner over the outside of the vessel 11 and terminates at a location below the plane containing the plate 37. The diameter of the shell 46 is greater than the diameter of the vessel so that a spacing 47 is provided therebetween. A generally circular and cylindrical wall member 48 is fixedly secured to the bottom surface of the plate 37, and the diameter thereof is less than the diameter of the shell 46 so as to define a radial spacing 49 therebetween greater in dimension than the spacing 47. An end wall member 51 is fixedly secured to the bottom end of the shell 46 and the bottom edge of the wall member 48. Thus, the radial spacing 52 between the shaft 14 and the wall 48 defines an annular passageway as shown in FIG. 4, and the radial spacing 49 between the wall 48 and the shell 46 defines an annular passageway as also illustrated in FIG. 4. The purpose of this particular passageway system will be explained in more detail below.

The central shaft 12 in the vessel 11 includes a cylindrical shell 53 secured to the upper surface of the plate 37 and extends coaxially with respect to the hole 38. The upper end of the shell 53 terminates at a location spaced below the plane containing the annular ring 36. An end wall 54 is secured to the upper end of the shell 53 to completely close off access from the interior of the shaft to the radial spacing 56 between the external surface of the shell 53 and the internal surface of the vessel 11. A further shell 57 is oriented internally of the shell 53 and is, like the shell 53, secured to the upper surface of the plate 37 and extends coaxially with respect to the hole 38. The shell 57 terminates at its upper end below the end wall 54 to define a spacing 58 therebetween. The diameter of the shell 57 is less than the diameter of the shell 53 so as to define a radial spacing 59 therebetween. A series of holes 61 are provided in the plate 37 in the radial space 59 to provide fluid communication between the radial space 59 and the radial space 52.

Referring now to FIG. 4, a pair of upright spaced walls 62 and 63 are connected to and extend between the shaft 14 and the shell 46 to define a passageway 64. The walls 62 and 63 both extend between and are in contact with the bottom surface of the plate 37 and the upper surface of the end wall member 51. A hole 66 is provided in the shaft 14 to provide fluid communication between the passageway 64 and the spacing 43 in the shaft 14. A hole 67 is provided in the plate 37 to provide fluid communication between the passageway 64 and the radial spacing 47. Similarly, a further hole 68 is provided in the plate 37 to provide fluid communication between the radial spacing 49 and the radial spacing 47.

Figure 2:
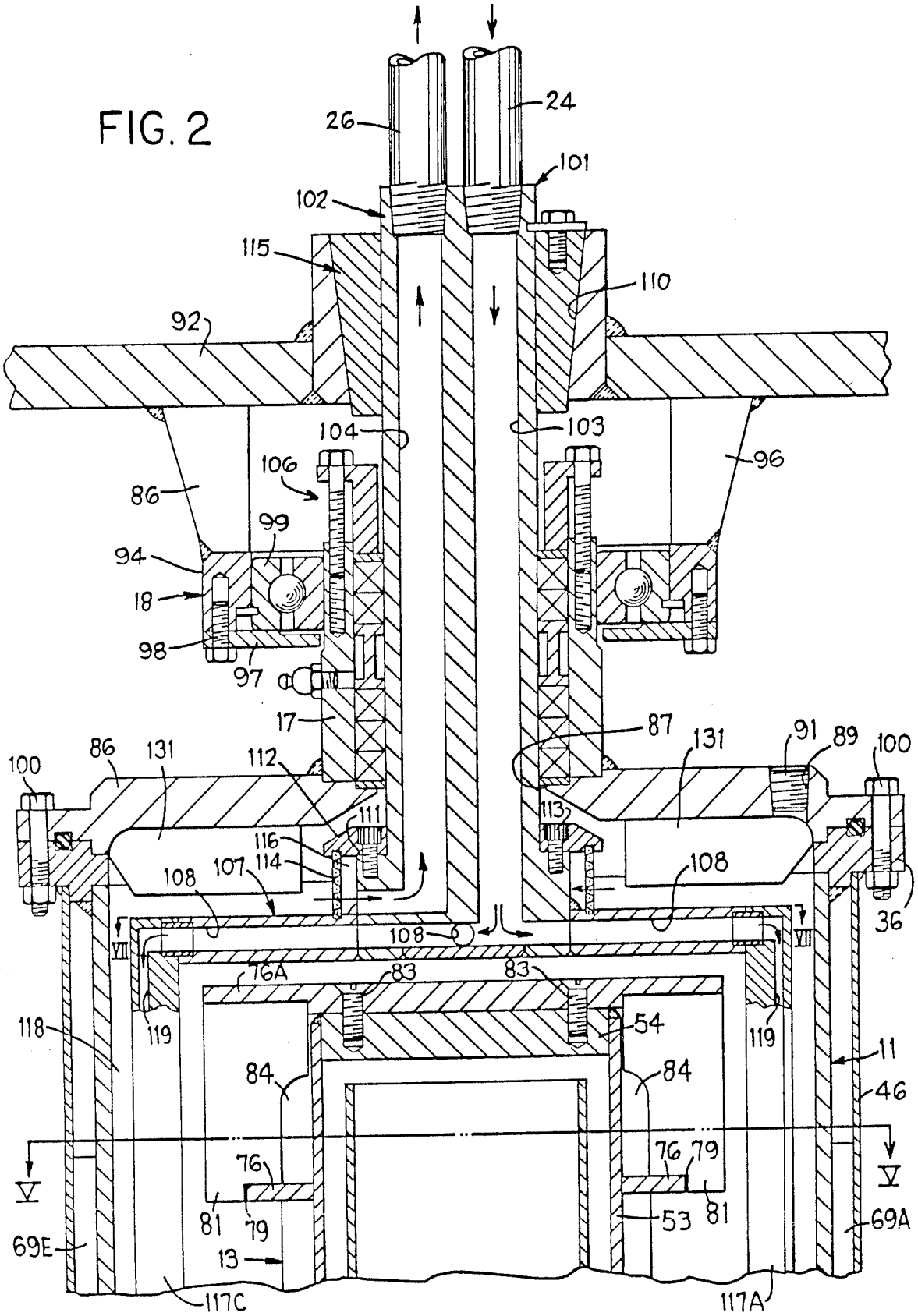
FIG. 2 is an enlarged sectional view of the upper portion of the vessel and the inlet and outlet structure for introducing and removing the particulate-containing substance to be processed.

The radial spacing 47 between the shell 46 and the vessel 11 is divided into plural vertically extending passageways by plural upstanding divider walls 69A to 69G. Divider walls 69A, 69C, 69E and 69G all terminate below the annular ring 36 as shown in FIGS. 2 and 3 and are connected at the other end to the plate 37. The divider walls 69B, 69D and 69F are secured at one end to the annular ring 36 and are spaced from the plate 37 as shown by the divider walls 69B and 69D in FIG. 3. A divider wall 71 (FIG. 3) is located between the holes 67 and 68 in the plate 37 and extends between the bottom plate 37 and the annular ring 36 to isolate the portion of the radial spacing 47 having the opening 68 therein from the portion of the spacing 47 into which the opening 67 provides communication.

A conventional cleanout opening 72 (FIG. 3) is provided through the shell 46 and the wall of the vessel 11. A conventional cover 73 (FIG. 1) is utilized to cover the cleanout opening 72 when the mill 10 is in operation.

Figure 5:
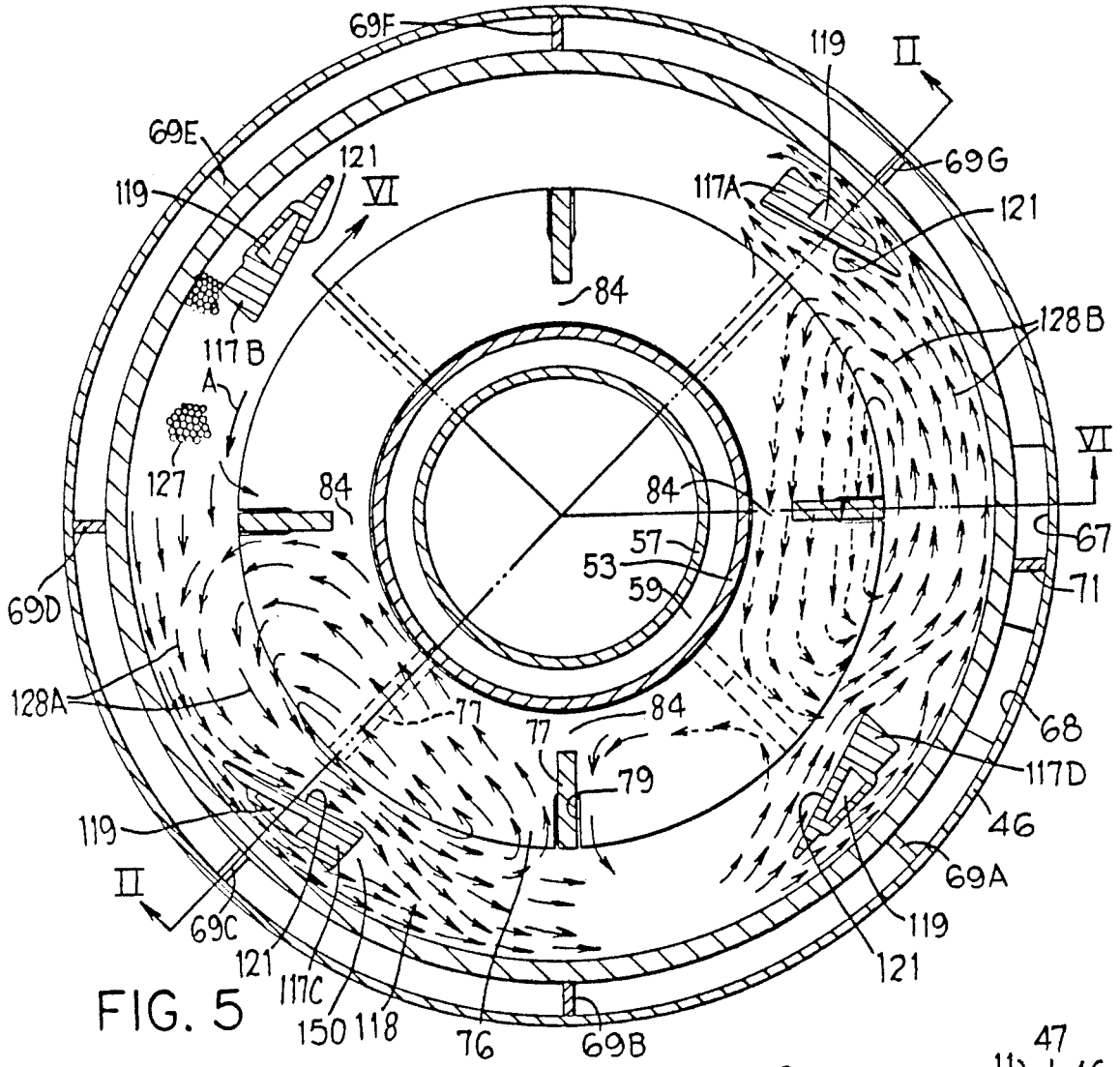
FIG. 5 is a sectional view taken along the line V—V of FIG. 2.
Figure 6:
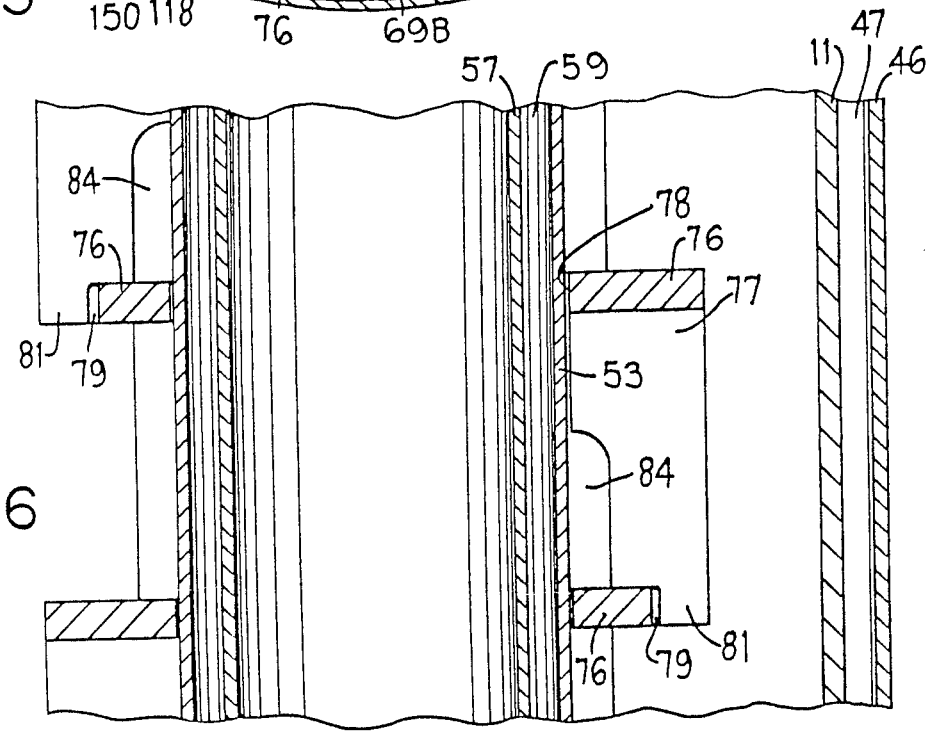
FIG. 6 is a sectional view taken along the line VI—VI of FIG. 5.

As stated above, a plurality of disc-blade sets 13 (FIG. 1) are fixedly secured to the shaft 12 in the vessel 11. More specifically, the disc-blade sets 13 each consist of a disc 76 and a plurality, here four, of downwardly extending blades 77 fixedly secured to the disc 76. The disc 76 has a central hole 78 (FIG. 6) therethrough of a diameter just slightly larger than the outer diameter of the shell 53. In this particular embodiment, the structure by which the disc-blade sets are each fixedly secured to the shaft and, therefore, the vessel 11 includes plural notches 79 in the radial edge of each disc 78. A tab portion 81 on the lower end of each blade 77 is received into a respective notch 79 (FIG. 6). In this particular embodiment, there are four such blades 77 as shown in FIG. 5 attached to each disc 76. The bottommost disc-blade set is slightly different in that the blades 77 do not have tab portions thereon but, instead, the lower end of the blades extend directly into recesses 82 provided in the upper surface of the plate 37 as shown in FIG. 1. In addition, the topmost disc-blade set is slightly different from the intermediate disc-blade sets in that a modified disc 76A (FIG. 2) does not have notches 79 in the radial extremity thereof. In addition, and as shown in FIG. 2, the modified disc 76A is secured by screws 83 threadedly received in threaded holes in the end member 54.

It is to be noted that each of the blades has a portion thereof cut away to define an opening 84. The purpose of this opening 84 will be explained in more detail below.

As is illustrated in FIG. 5, each disc-blade set 13 is oriented 45° offset from the next adjacent disc-blade set. The purpose of this offset arrangement will be explained below.

A cover 86 (FIG. 2) is provided on the upper end of the vessel 11 and matingly engages the upper surface of the annular ring 36. A central hole 87 extends through the cover 86. An upstanding neck portion 17 is secured to the upper surface of the cover and encircles the hole 87. The neck portion is generally cylindrical and extends upwardly away from the plane of the cover. The cover 86 also has a hole 89 adjacent the radial extremity thereof to facilitate a visual inspection of the interior of the vessel 11 when the cover 86 is in place. During operation, however, the hole is closed by an appropriate plug 91.

The support 33 includes a plate member 92 having the bearing construction 18 suspended therefrom. The bearing construction 18 includes an annular ring 94 secured through plural depending web members 96 to the undersurface of the plate 92. An annular platelike ring 97 is secured to the bottom surface of the annular ring 94 by any conventional means, as screws 98, which annular ring 97 extends radially inwardly from the bottom edge of the annular ring 94 to define a shelf. A bearing 99 having an inner race and an outer race is mounted on the upper surface of the shelf portion of the ring 97. The outer race of the bearing 99 engages the internal surface of the annular ring 94 and the inner race of the bearing engages the outer surface of the neck portion 17 to thereby provide a bearing support for the upper end of the vessel 11 when the cover 86 is securely fastened to the vessel 11 by plural bolts 100.

Figure 7:
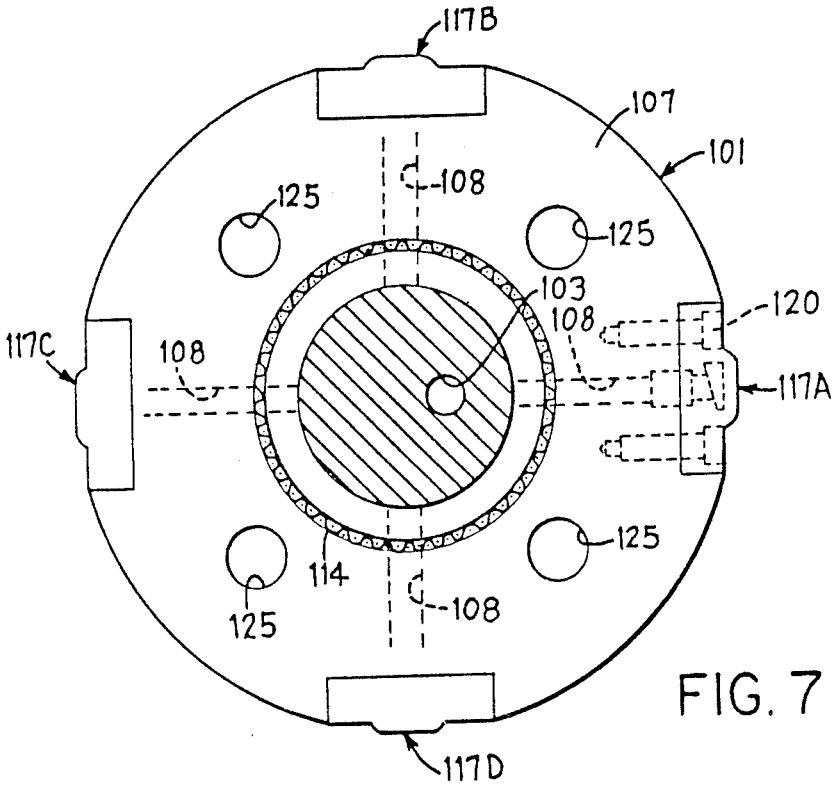
FIG. 7 is a sectional view taken along the line VII—VII of FIG. 2.

An inlet-outlet member 101 is provided and is received into the opening defined by the neck portion 17 and the opening 87 in the cover 86. More specifically, the inlet-outlet member 101 includes an inverted T-shaped member wherein the stem portion 102 thereof is received in the opening defined by the neck portion 17 and the opening 87 in the cover 86. The stem portion 102 has a pair of parallel channels 103 and 104 therein which are connected respectively in fluid circuit to the inlet connection 24 and the outlet connection 26. A conventional packing seal mechanism 106 is provided between the exterior surface of the stem portion 102 and the interior surface of the neck portion 17. The cross portion 107 of the inverted T-shaped inlet-outlet member extends into the spacing between the uppermost disc 76A and the cover 86. Furthermore, the cross portion is generally circular in shape and extends radially beyond the radial extremity of each of the discs 76,76A in each of the disc-blade sets. Furthermore, the cross portion 107 has plural, here four, passageways 108 therein as shown in FIG. 7 extending radially outwardly from a central portion thereof and connected in fluid circuit with the passageway 103. The passageways 103 and 108 are isolated from the passageway 104.

A step 111 is provided in the peripheral surface of the stem portion 102 just above the cross portion 107 and an annular collar 112 is mounted thereon and fixed thereto by means of plural screws 113. The annular collar 112 extends radially outwardly from the surface of the stem portion 102. A filter screen 114 is clamped between the undersurface of the collar 112 and the upper surface of the stem portion 107. The passageway 104 opens into a chamber 116 encircling the periphery of the stem portion 102 between the collar 112 and the upper surface of the cross portion 107 immediately inside the filter screen 114.

The upper end of the stem portion 102 is tightly received in an opening 110 in the plate 92 by means of a conical wedge structure 115.

Plural deflector members, here four, 117A through 117D are connected to the radial extremity of the circular cross portion 107 of the inlet-outlet member 101 as shown in FIGS. 5 and 7. The deflector members each extend into a spacing 118 (FIG. 2) located between the radial extremity of the disc-blade sets 13 and the interior surface of the outer wall of the vessel 11. Generally, no moving surface shall be closer than four (4) media diameters from a stationary surface. Each of the deflector members has an opening 119 extending longitudinally therethrough and which is connected in fluid circuit with a respective one of the radial passageways 108 in the cross portion 107. As illustrated in FIG. 5, each deflector member is wedge-shaped with the surface 121 thereon being angled inwardly from a circle containing the narrowestmost end thereof. More specifically, the wedge-shaped member diverges in shape in a direction that is the same as the direction of rotation of the vessel as shown by the arrow A in FIG. 5. Each of the deflector members 117A through 117D is fastened by any convenient means to the periphery of the cross portion 107 as by bolts 120 as shown in FIG. 7 which extend through the upper end of the deflector members and radially inwardly into the radial edge of the cross portion 107. It will be important in order to prevent the deflector members from moving about an axis of a securing bolt that the bolts be spaced on opposite sides of the passageway 119 as illustrated in FIG. 7.

Plural holes 125 (FIG. 7) are provided in and extend through the cross portion 107 to permit the flow of processed product therethrough as will be explained in more detail below.

Figure 8:
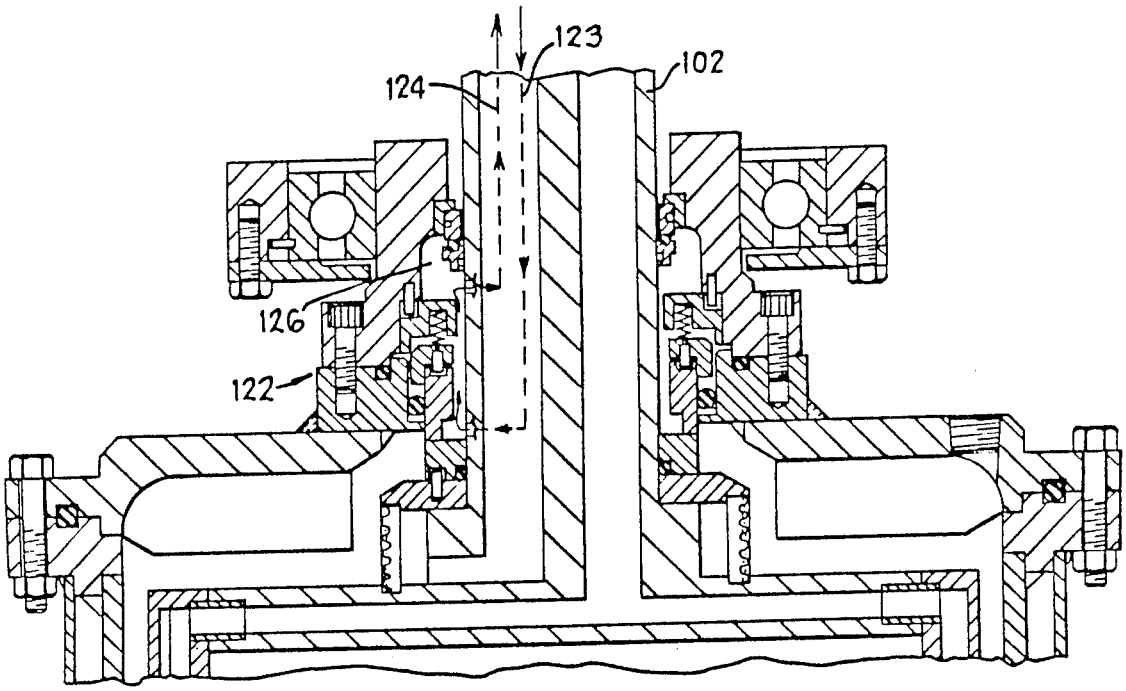
FIG. 8 is a central sectional view of the upper portion of the vessel and illustrating a modification to the seal structure.

FIG. 8 is similar in many respects to the illustrations in FIG. 2. However, FIG. 8 illustrates a mechanical seal 122 which is utilized instead of the packing seal 106. A barrier fluid is supplied through passageways schematically illustrated at 123 and 124 in the stem portion 102 to the cavity 126 in the mechanical seal construction.

OPERATION

Upon an energization of the electric motor 19, the output shaft 21 thereof will drive through the variable speed transmission device 22 the shaft 14 to effect a rotation of the shaft 12, the disc-blade sets 13 thereon and the vessel 11 in the axially spaced bearing supports 16 and 18. Comminuting media, schematically illustrated at 127 in FIG. 5, is present in the vessel 11 and agitation thereof is started upon the attainment of a specified speed of rotation for the vessel 11. As the vessel attains a desired critical speed, namely, that speed which causes the media to centrifuge, the media will move into an upright cylindrical column spaced radially outwardly from the shell 53. The media will be centrifuged based on the following formula:

$$F = \frac{WV^2}{gR} = \frac{WRN^2}{2933} = .000341\ WRN^2$$

wherein:

F=centrifugal force tending to move the body of a single comminuting media outward from the axis of rotation (in pounds);

W=weight of body in pounds;

V=velocity of center of gravity of the body (feet per second);

g=acceleration due to gravity (commonly 32.16 feet per second$^2$);

R=distance from the axis of rotation to the center of gravity of the body (in feet);

N=revolutions per minute.

Due to the physical laws of centrifugal force, it follows that the effective weight of a body varies as the square of the rotational speed. This phenomena allows a small-size media to create a force equal to a larger media when subjected to high centrifugal force. Further, the use of a smaller diameter media allows for a greater number of media to be provided in a given space and, therefore, the number of contacts between media is increased, thereby creating more available forces for shear and impact. Further, the efficiency of the media is substantially improved over known mills primarily since the present apparatus will permit a use of media having a smaller size, thereby increasing the effectiveness of the milling device.

It is to be noted that the mill effects a positive driving of the media. The amount of slippage between the media and the driving disc-blade sets 13 is very small. Generally, it can be said that the media is locked into a vane cavity until it is accelerated outwardly as shown by the path generally indicated at 128A illustrated in FIG. 5. The paths generally indicated at 128B are in a plane below the plane of the paths 128A. That is, the movement of the media in the paths 128B is controlled by the blades 77 shown in broken lines in FIG. 5. As the media is accelerated outwardly, it will collide with other media and the particles in the product to be processed and eventually be diverted by the surface 121 radially inwardly into a further vane cavity and remain there until the next available blade 77 comes along to reaccelerate same radially outwardly.

Upon the appropriate speed being attained by the apparatus, product is introduced into the inlet 24 and passageway 103 so that the incoming product will flow down through the passageways 119 in each of the deflector members 117A through 117D and be introduced into the vessel as at 129 (FIG. 1) adjacent the plate 37. Thus, and due to hydraulic action, the product will move upwardly through the media through the holes 125 in the cross portion 107 as well as around the radial edges thereof and out through the filter screen 114 and thence into the chamber 116 and passageway 104 to the outlet connection 26. Plural blades 131 are provided on the underside of the cover 86 to agitate the product while the fluid is preparing to exit via the filter screen 114, chamber 116 and passageway 104.

If products being processed contain certain organic solvents which attack conventional packing materials, or the product is toxic in nature requiring zero emissions, the packing seal can be exchanged for a mechanical seal, such as illustrated in FIG. 8.

An advantage to be achieved by introducing product at four arcuately spaced locations 129 adjacent the plate 37 causes the product to be evenly distributed throughout the vessel and forces the product through several media action zones. Further, the discs 76,76A will prevent the product to be processed from moving upwardly along the outer surface of the shaft 12. In other words, the structure of the disc-blade sets 13 assures that the product to be processed is moved entirely through the agitated media.

If the media deflected radially inwardly into a disc-blade or vane cavity, namely, that arcuate space between mutually adjacent blade members 77, exceeds the capacity of that particular cavity, media will be permitted to flow from one disc-blade cavity to a mutually adjacent disc-blade cavity through the opening 84 provided in each of the blade members 77. However, in many applications, no such opening 84 will be required.

Further, and as shown in FIG. 5, it will be noted that as a blade passes by a deflector member, all of the forces so generated by such movement will be evenly balanced around the vessel since the number of blades equals the number of deflector members to dynamically balance the mill. However, the number of deflector members and blades can be unequal but the structure will require reinforcement to absorb any vibrations which may occur.

If the heat generated during processing becomes excessive, heat exchange fluid can be introduced into the inlet connection 28 and pipe 41 into the interior of the shaft 12. As illustrated by the arrows in FIG. 3, the flow of heat exchange fluid will eventually enter the plural openings 61 in the plate 37, thence through the space 52 and space 49 so as to enter an opening 68 in the plate 37 and pass upwardly along the exterior wall surface of the vessel 11 in the radial spacing 47 provided therefor. The heat exchange fluid will then pass over the top of the divider wall 69A, pass under the divider wall 69B, pass over the top of divider wall 69C, pass under the divider wall 69D, pass over the top of divider wall 69E, pass under the divider wall 69F and over the top of divider wall 69G so as to exit through the opening 67 in the plate 37 and pass through the channel 64 into the passageway 43 which is connected to the outlet connection 31 and outlet line 32. Similarly, if the operating temperature of the milling operation is not high enough, heating fluid can be introduced through the inlet connection 28 in a similar manner.

The following examples were run utilizing a continuous type mill disclosed hereinabove.

EXAMPLE 1

PRODUCT TO BE PROCESSED

Paint, proprietary formula, pigmented, epoxy base vehicle end use metal furniture, finish coating. Object was to achieve a grind reading of 7 (12.5 microns) on the Hegman N.S. scale.

EXISTING METHOD

Batch ball mill using 10 horsepower and 1 inch diameter ceramic balls. Production rate 12 gallons per hour. (192 gallons each 16 hours) Grind reading, 7 Hegman.

INVENTIVE METHOD

Presently disclosed mill using 10 horsepower, and 1.5 mm. modified ceramic ball, continuous flow process at 20.49 gal. per hour. Grind reading—7½ (6.25 microns) Hegman.

CONCLUSION

A 70% increase in productivity using equal power.

EXAMPLE 2

PRODUCT TO BE PROCESSED

Government specification Red Oxide metal primer. Object was to achieve a grind reading of 5 (37.5 microns) on Hegman N.S. scale.

| RAW MATERIALS | BY WEIGHT |
|---|---|
| Raw Red Oxide Pigment | 32% |
| Zinc Chromate | 6% |
| Talc (magnesium silicate) | 13% |
| Zinc Oxide | 6% |
| Ground Limestone | 6% |
| Alkyd resin, mineral spirits additives | 37% |
| | 100% |

EXISTING METHOD

Ball mill using 10 horsepower motor and ⅝ inch diameter steel balls. Production rate achieved was 12 gallons per hour (192 gallons each 16 hours). Achieved a 5 (37.5 microns) grind on Hegman N.S. scale.

INVENTIVE METHOD

The present mill using 10 horsepower continuous flow and process achieved a 37½ gallons per hour using steel shot (1.5 mm. in diameter) as grinding media and achieved the same 5 (37.5 microns) grind on the Hegman N.S. scale.

CONCLUSION

A 213% increase in productivity was achieved with the presently disclosed device. In both instances, the amount of processed product per amount of energy was substantially increased over existing methods of processing the same material.

ALTERNATE CONSTRUCTION

Figure 9:
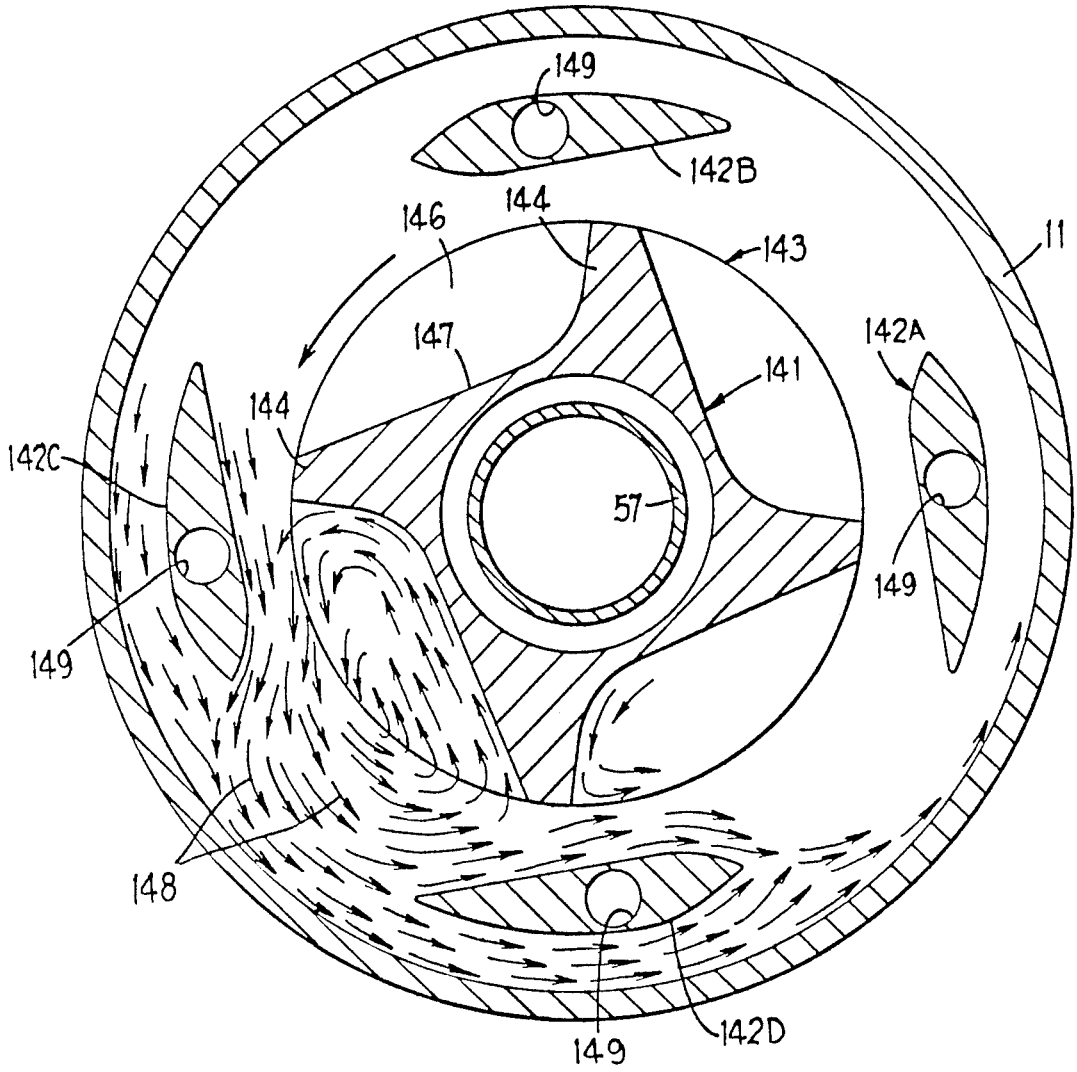
FIG. 9 is a sectional view of a modified embodiment taken along a line corresponding to V—V in FIG. 2.

FIG. 9 illustrates an alternate embodiment of a central shaft 141 and plural, here four, deflector members 142A to 142D. The central shaft 141 is composed of a plurality of vertically spaced disk-blade sets 143 each interlocked to the other and with the bottommost one interlocked to the bottom wall 37 of the vessel 11 in a manner identical to that described hereinabove. In this particular embodiment, however, each disk-blade set 143 is integrally formed, as by casting same out of a cast metal or plastic material. Appropriate but not illustrated tabs can, for example, be provided on each blade 144 which project into appropriate openings provided on the upper surface of each disk 146. It will be noted that in this particular embodiment, there is a smooth transition surface 147 between a blade 144 and the next mutually adjacent blade 144. Further, it will be noted that there is no hole through the blade members similar to the openings 84 (FIG. 5) between the blade 77 and the outside diameter of the shell 53. More specifically, the surface 147 joining one blade to another mutually adjacent blade is of a contour that closely conforms to the paths of movement 128A and 128B of the media 127 utilized in the vessel 11 of FIG. 5.

Each deflector member 142A to 142D has an opening 149 therethrough similar to the opening 119 (FIG. 5) to permit the introduction of product to be processed at a location adjacent the bottom wall 37 of the vessel.

The advantage achieved by the embodiment of FIG. 9 over the embodiment described above is in the shape of the individual disk-blade sets 143, particularly the smooth transition surface 147 between the mutually adjacent blades 144 and the shape of each of the deflector members 142A through 142D. Each deflector member has a cross section similar to an air foil so that the media moving in the paths of movement 148 will not generate voids. Referring to FIG. 5, there is a void 150 at the trailing edge of each deflector member 117A to 117D. It is conceivably possible, therefore, for product to be processed to move up the trailing edge of each deflector member and simply pass through the mill without being processed by the media. To eliminate this potential problem, the embodiment disclosed in FIG. 9 eliminates the creation of voids at the trailing edge of the deflector members. In addition, the shape of the trailing edge of the deflector members is such as to maximize the drawing of media away from the internal surface of the vessel 11. Every effort should be made in the design of the deflector members to prevent voids from being generated so as to cause a potential for product to be processed to move through the voids to the outlet. Since each disk-blade set 143 is offset, here 45°, from the next vertically spaced disk-blade set, continuity in the path of movement of the product to be processed from the bottom of the vessel to the top thereof will be distributed thereby insuring proper action of the media thereon to achieve the desired finished product.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for effecting, in a mill containing a particulate-containing substance, a reduction in size of said particluate, the steps comprising:

placing said substance an a comminuting media into a comminuting vessel having a finite depth and having a centrally disposed shaft therein affixed to said vessel;

rotating said vessel and said shaft;

centrifically flinging all of said comminuting media radially outwardly in response to said rotating of said vessel and said shaft at a sufficient speed, thereby causing all of said comminuting media to rotate enmasse with said vessel and move into an upright cylindrical column over the full depth of the vessel spaced radially outwardly from said shaft;

splitting said column of comminuting media along the full depth of said vessel into a radially inner portion and a radially outer portion by causing the rotating columnar mass of comminuting media to encounter at least one stationary deflector in said vessel that is equidistantly spaced from the wall of said vessel over the full depth of said vessel;

deflecting only said radially inner portion of said comminuting media in a radially inwardly direction, and then centrifical flinging said radially inner portion radially outwardly;

causing said radially outer portion of said comminuting media to arcuately move past said deflector on a radially outer side thereof;

imparting shear and impact forces on said particulate by contacting said particulate with said comminuting media that is moving radially inwardly, radially outwardly, and arcuately and said arcuate movement of said radially outer portion of said commuting media; and controlling the speed of rotation of said comminuting vessel and said shaft to a selected speed, thereby causing said media to exert the requisite amount of said shear and said impact forces on said particulate in said particulate-containing substance, thereby effectively reducing the size of said particulate to a desired size.

2. The method of claim 1, wherein said mill is a continuous-type mill, and including introducing into the interior of said vessel at one end and removing said substance from the interior of said vessel at another end, and passing said substance through said column of comminuting media between said ends of said vessel.

3. The method of claim 1, including controlling said shear and impact forces of said media against said particulate by said speed of rotation of said vessel in accordance with the formula $$F = \frac{WV^2}{gR} = \frac{WRN^2}{2933} = .000341\ WRN^2$$

wherein:

F=centrifugal force tending to move a single comminuting media outward from the axis of rotation (in pounds);

W=weight of the single comminuting media in pounds;

V=velocity of center of gravity of the single comminuting media (feet per second);

g=acceleration due to gravity (commonly 32.16 feet per second$^2$);

R=distance from the axis of rotation to the center of gravity of the single comminuting media (in feet);

N=revolutions per minute.

* * * * *